US008858352B2

(12) United States Patent
Jun

(10) Patent No.: US 8,858,352 B2
(45) Date of Patent: Oct. 14, 2014

(54) WRIST GUARD FOR BOWLING

(71) Applicant: Sang-Hak Jun, Gyeonggi-do (KR)

(72) Inventor: Sang-Hak Jun, Gyeonggi-do (KR)

( * ) Notice: Subject to any disclaimer, the term of this patent is extended or adjusted under 35 U.S.C. 154(b) by 0 days.

(21) Appl. No.: 14/075,394

(22) Filed: Nov. 8, 2013

(65) Prior Publication Data

US 2014/0066218 A1 Mar. 6, 2014

Related U.S. Application Data

(63) Continuation of application No. 13/703,297, filed as application No. PCT/KR2011/004229 on Jun. 9, 2011.

(30) Foreign Application Priority Data

Jun. 25, 2010 (KR) ..... 20-2010-0006723 U

(51) Int. Cl.

| | |
|---|---|
| ***A63B 69/00*** | (2006.01) |
| ***A63F 5/04*** | (2006.01) |
| ***A63B 71/14*** | (2006.01) |
| ***A41D 19/015*** | (2006.01) |

(52) U.S. Cl.

CPC ..... *A63B 69/0046* (2013.01); *A63B 71/148* (2013.01); *A41D 19/01588* (2013.01)

USPC ..... 473/62; 2/162; 602/16; 602/21

(58) Field of Classification Search

USPC ..... 473/61–63; 2/16, 20, 159, 160, 162, 2/163, 170; 602/5, 16, 21; 482/45

See application file for complete search history.

(56) References Cited

U.S. PATENT DOCUMENTS

| | | | | | |
|---|---|---|---|---|---|
| 3,606,342 | A | * | 9/1971 | Albertson | 473/62 |
| 3,707,963 | A | * | 1/1973 | Keropian | 602/21 |
| 4,371,163 | A | * | 2/1983 | Shaffer et al. | 473/61 |
| 4,608,720 | A | * | 9/1986 | Purin | 2/161.1 |
| 4,618,147 | A | * | 10/1986 | Hurd et al. | 473/62 |
| 4,660,550 | A | * | 4/1987 | Bodine | 602/16 |
| 4,666,158 | A | * | 5/1987 | Moro | 473/62 |
| 4,925,187 | A | * | 5/1990 | Fleenor et al. | 473/62 |
| 5,163,678 | A | * | 11/1992 | Rogers | 473/59 |
| 5,254,078 | A | * | 10/1993 | Carter et al. | 602/21 |
| 5,466,192 | A | * | 11/1995 | Castolo et al. | 473/62 |
| 5,611,735 | A | * | 3/1997 | Jackson | 473/60 |

(Continued)

FOREIGN PATENT DOCUMENTS

| | | | |
|---|---|---|---|
| KR | 20-0280206 | Y1 | 7/2002 |
| KR | 20020024355 | Y1 | 11/2003 |
| KR | 2004-0006053 | Y1 | 6/2004 |

OTHER PUBLICATIONS

"International Application No. PCT/KR2011/004229 International Search Report", Feb. 28, 2012, Publisher: PCT, Published in: KR.

*Primary Examiner* — William Pierce

(74) *Attorney, Agent, or Firm* — Kaplan Breyer Schwarz & Ottesen, LLP

(57) ABSTRACT

A wrist guard for bowling is provided. The wrist guard is capable of easily swing-adjusting (laterally adjusting) or tilt-adjusting (longitudinally adjusting) while a user is putting on the wrist guard, thereby proving a stable posture and convenience of use, also providing a beautiful exterior obtained by covering an angle adjusting unit swing-adjusting or tilt-adjusting using a cover, and preventing holding a cloth in such a way that the user is able to concentrate on a bowling game while throwing a bowling ball.

6 Claims, 3 Drawing Sheets

(56) References Cited

U.S. PATENT DOCUMENTS

| | | | | |
|---|---|---|---|---|
| 5,653,680 | A * | 8/1997 | Cruz | 602/21 |
| D404,818 | S * | 1/1999 | Cruz | D24/190 |
| 5,882,323 | A * | 3/1999 | Belkin | 602/21 |
| 5,954,678 | A * | 9/1999 | Cruz | 602/26 |
| 6,361,447 | B1 * | 3/2002 | Lindstrom | 473/62 |
| 6,592,538 | B1 * | 7/2003 | Hotchkiss et al. | 602/26 |
| 6,827,653 | B2 * | 12/2004 | Be | 473/62 |
| 6,942,632 | B2 * | 9/2005 | Cho | 602/64 |
| 7,043,769 | B2 * | 5/2006 | Chung | 2/161.1 |
| 7,081,102 | B1 * | 7/2006 | Koetter et al. | 602/21 |
| 7,124,536 | B2 * | 10/2006 | Harkey | 43/21.2 |
| 7,389,544 | B1 * | 6/2008 | Biggerstaff | 2/16 |
| 7,402,148 | B2 * | 7/2008 | Brewer | 602/21 |
| 7,785,210 | B2 * | 8/2010 | Lee | 473/62 |
| 7,954,175 | B2 * | 6/2011 | Platt | 2/161.5 |
| 8,603,018 | B2 * | 12/2013 | Anglada | 602/21 |

* cited by examiner

WRIST GUARD FOR BOWLING

CROSS-REFERENCE TO RELATED APPLICATION(S)

U.S. patent application Ser. No. 13/703,297 with a 371 entry date of Dec. 10, 2012; PCT Application PCT/KR2011/004229 with a filing date of Jun. 9, 2011; and Korean Patent Application KR 20-2010-0006723 with a filing date of Jun. 25, 2010, are incorporated herein by reference.

TECHNICAL FIELD

The present invention relates to a wrist guard for bowling, capable of reducing a phenomenon of hand rocking right and left and a load on a wrist and improving athletic performance while throwing a bowling ball in a game, and more particularly, to a wrist guard for bowling, capable of simply swing-adjusting or tilt-adjusting a plate for the back of a hand.

BACKGROUND ART

Generally, while a player throws a bowling ball while playing a bowling game, the player puts on a wrist guard to prevent an injury caused by excessively bending an intercapal joint due to the weight of the bowling ball, to prevent hand-rocking due to a transfer of the centroid according to a rotational variance of the bowling ball, to keep a proper track simultaneously with allowing ball throwing in a definitely desired direction.

A wrist guard includes a back plate closely attached to the back of a hand, a wrist plate closely attached to a wrist, and an angle adjusting unit capable of adjusting the back plate to be swung or vertically tilted with respect to the wrist plate.

To tightly put the wrist guard on the back of a hand and the wrist, there are installed at the back plate and the wrist plate.

However, since a conventional wrist guard exposes a swing-adjusting member or a tilt-adjusting member outside on a back plate or a wrist plate thereof, an exterior is shoddy, competitiveness of goods decreases, there is an inconvenience of readjusting when a control unit concentrated on the back of a hand is bumped against facilities, and concentration on a game is decreased when clothes of a user is hold by exposed parts in the game, thereby causing a safety accident of falling due to losing the balance of the user.

Also, the conventional wrist guard is difficult to control the swing-adjusting member or the tilt-adjusting member using a finger while the user puts on the wrist guard, it is very inconvenient.

Also, since a fastening band of the conventional wrist guard is not strong, the wrist guard arbitrarily rocks, thereby deteriorating wearability not to allow the user to concentrate a bowling game.

DISCLOSURE OF THE INVENTION

Technical Problem

The present invention provides a wrist guard for bowling, capable of easily swing-adjusting (laterally adjusting) or tilt-adjusting (longitudinally adjusting) while a user is putting on the wrist guard, thereby proving a stable posture and convenience of use.

The present invention also provides a wrist guard capable of providing a beautiful exterior obtained by covering an angle adjusting unit swing-adjusting or tilt-adjusting using a cover, thereby preventing holding a cloth in such a way that the user is able to concentrate on a bowling game.

The present invention also provides a wrist guard capable of providing excellent wearability by keeping an initially set state not to rock a wearing state in such a way that the user stably plays a bowling game.

Technical Solution

To achieve objects described above, according to an aspect of the present invention, there is provided a wrist guard for bowling including a wrist plate, closely attached to a wrist of a user, where a stably-mounting part is formed on one side thereof, a swing bracket, pin-connected to the stably-mounting part to be rotatable, a tilt bracket, installed on the swing bracket to be slidable, where a coupling groove is formed on one side thereof, a back plate for the back of a hand, pin-connected to the swing bracket to be rotatable, including a protrusion coupled with the coupling groove, a swing-adjusting unit variably adjusting a swing angle of the back plate with respect to the wrist plate, a tilt-adjusting unit variably adjusting a tilt angle of the back plate with respect to the wrist plate, a cover installed on the wrist plate to cover the swing-adjusting unit and the tilt-adjusting unit, operating one of the swing-adjusting unit and the tilt-adjusting unit by sliding, and fastening members fastening the wrist plate and the back plate to the wrist and the back of a hand to be detachable.

The swing-adjusting unit includes a gear part formed on an outer surface of the swing bracket, a first stopper, opposite to the gear part, mounted on a mounting groove formed on the wrist plate and selectively outer-geared with the gear part, and an elastic member installed inside the mounting groove to elastically support the first stopper.

The tilt-adjusting unit includes a pinion gear fastened inside the tilt bracket to be rotatable, a rack gear part formed on an inner surface of the tilt bracket to be outer geared with the pinion gear, a second stopper, opposite to the pinion gear, mounted on a mounting groove formed inside the swing bracket and selectively outer-geared with the pinion gear, and an elastic member installed inside the mounting groove to elastically support the second stopper.

A first protrusion and a second protrusion are formed on top surfaces of the first stopper and the second stopper, respectively, and a first insertion groove and a second insertion groove are formed on a bottom of the cover to correspond to the first protrusion and the second protrusion.

The first insertion groove is formed in the shape of a slit to contain the first protrusion transferred in a direction of a straight line and the second insertion groove is formed in the shape of a square to contain the second protrusion while swinging the swing bracket.

Fastening holes are formed on sides of the wrist plate and the back plate, respectively, to be engaged with one ends of the fastening members, locking grooves are formed on the wrist plate and the back plate, respectively, to attach or detach a locker fastened to another ends of the fastening members, and the locking grooves include locking parts and engaging parts, respectively, the engaging parts, connected to the locking parts, preventing a separation of the locker transferred from the locking part.

Advantageous Effects

As described, above, a wrist guard for bowling according to the present embodiment provides high convenience and reliability since a user, even a beginner, is able to simply swing-adjust or tilt-adjust while putting the wrist guard.

Also, an exterior thereof is simple to increase competitiveness thereof since an angle adjusting unit swing-adjusting or tilt-adjusting is covered by a cover, rocking of a wrist occurring due to a transfer of the centroid while playing a bowling game is prevented, a proper track is kept, and ball throwing is progressed in a definitely desired direction, and holing a cloth of the user is prevented to allow the user to maximize concentration.

Also, since the wrist guard includes fastening members (fastening bands) used to increase wearability and continuously keep a wearing state in such a way that the user stably plays the bowling game.

Also, since the wrist guard allows the use to hear degrees of rotation via a clicking sound while swing-adjusting or tilt-adjusting, the wrist guard is very convenient to use.

DESCRIPTION OF REFERENCE NUMBERS

Figure 1:
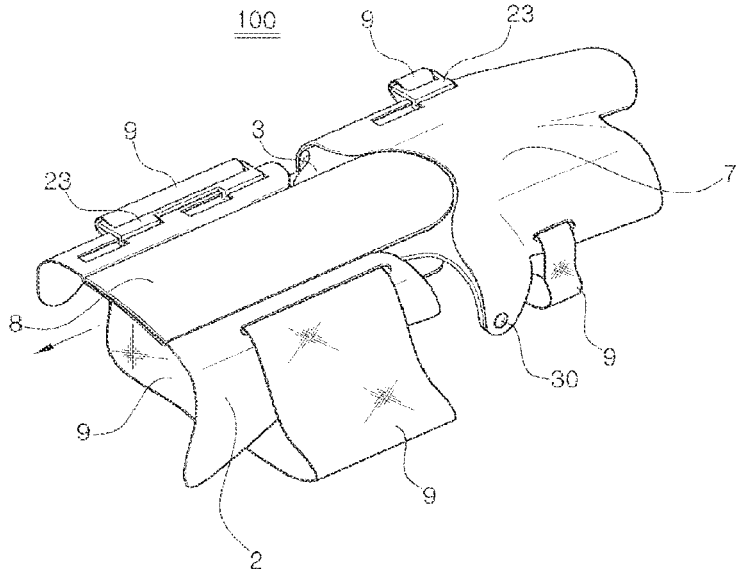
FIG. 1 is a perspective view illustrating a wrist guard for bowling in a arranged state according to a first embodiment of the present invention.

1: a stably-mounting part 3: a swing bracket
5: a tilt bracket 7: a back plate
9: fastening members 11: a mounting groove
13: an elastic member 15: a rack gear part
17: a second stopper 19: a first protrusion.
21: a second insertion groove 23: lockers
25: engaging parts 27: a first insertion groove

MODE FOR CARRYING OUT THE INVENTION

Hereinafter, there will be described a wrist guard for bowling according to an exemplary embodiment of the present invention in detail with reference to the attached drawings.

Figure 2:
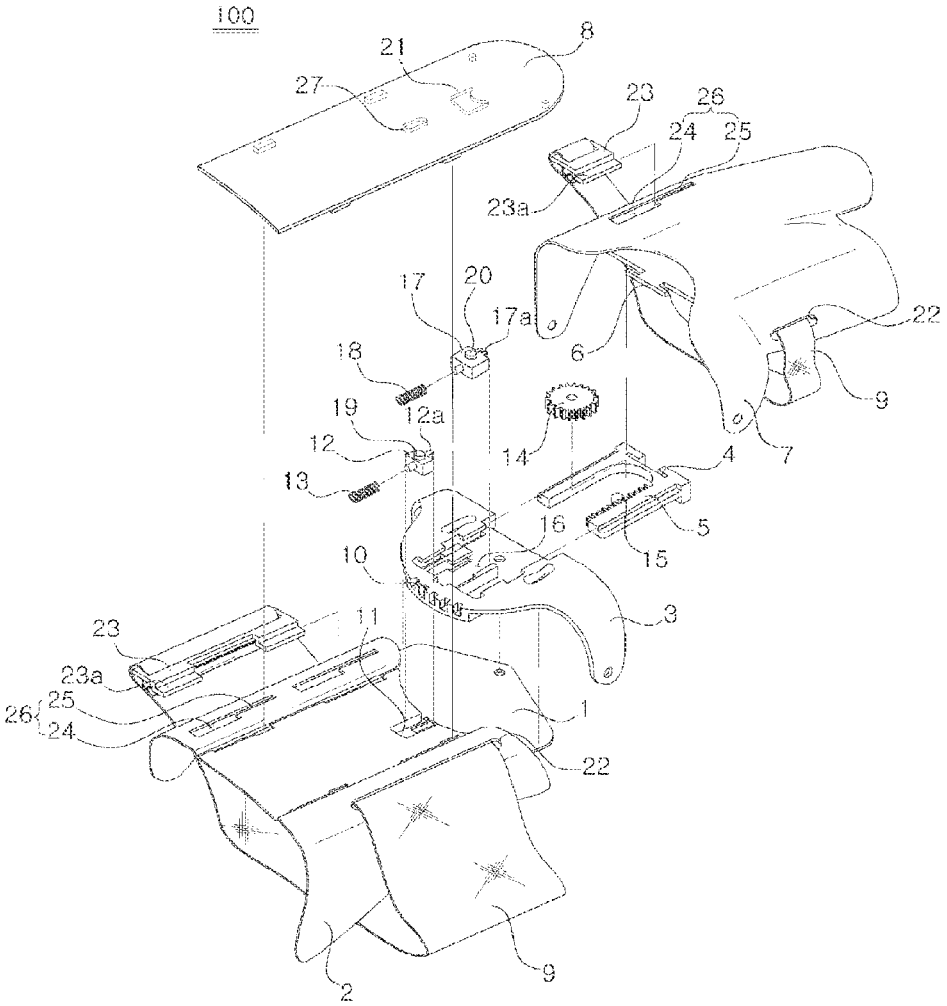
FIG. 2 is an exploded perspective view illustrating the wrist guard according to the first embodiment.
Figure 3:
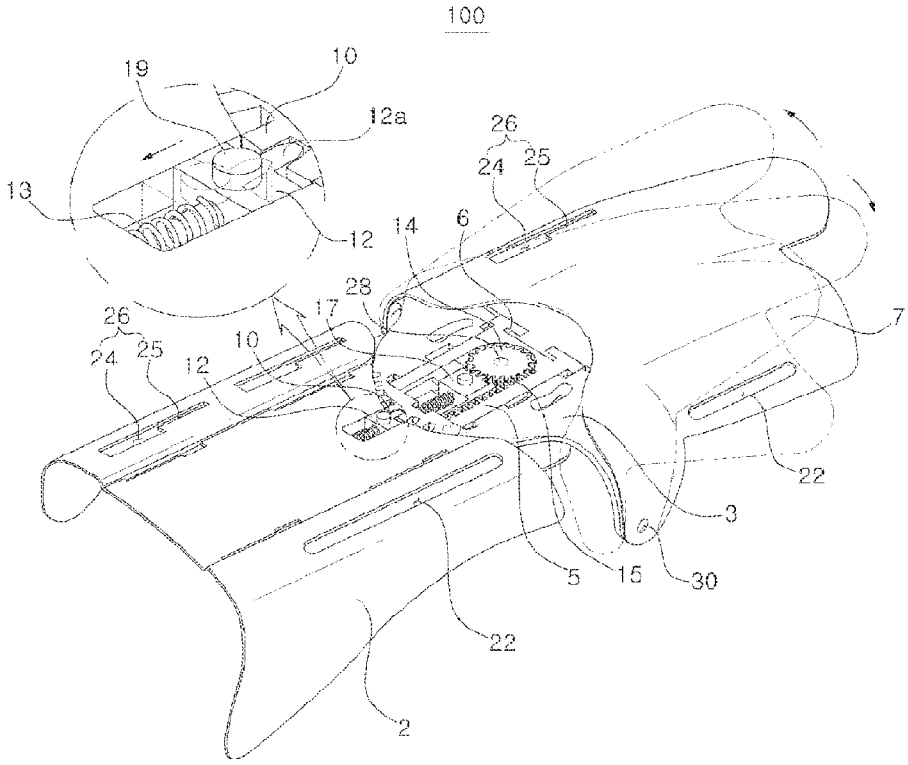
FIG. 3 is a view illustrating swing adjustment in the wrist guard according to the first embodiment.
Figure 4:
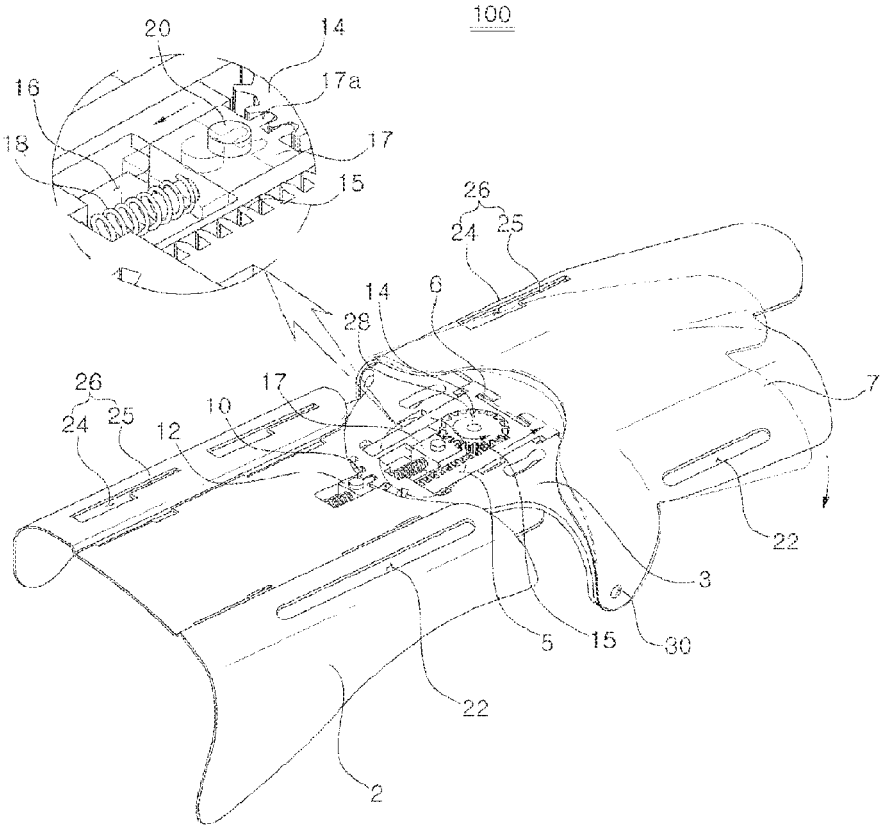
FIG. 4 is a view illustrating tilt adjustment in the wrist guard according to the first embodiment.
Figure 5:
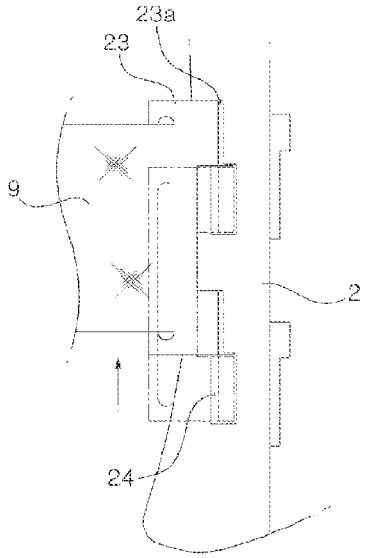
FIGS. 5 and 6 are top views illustrating states of locking and unlocking a fastening band in the wrist guard according to the first embodiment.
Figure 6:
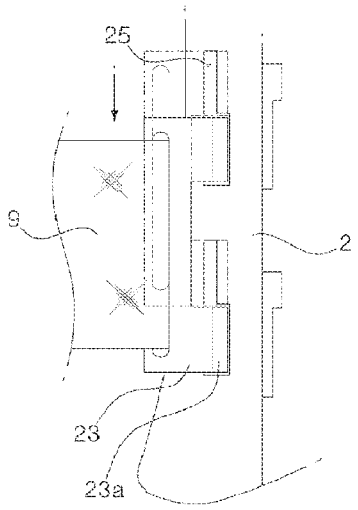
Figure 7:
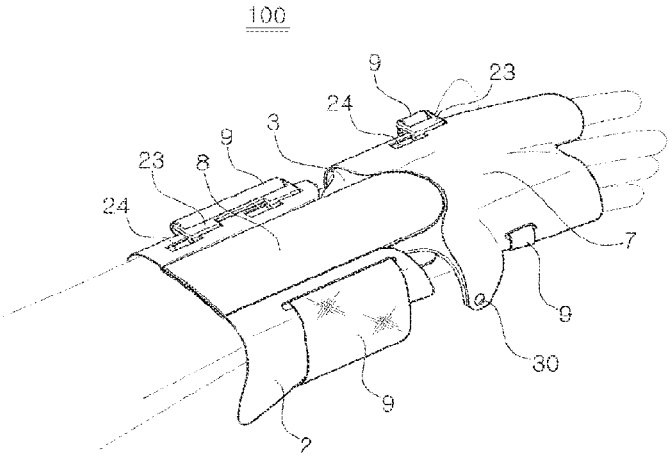
FIG. 7 is a view illustrating a state of putting the wrist guard according so the first embodiment on a hand.

FIG. 1 is a perspective view illustrating a wrist guard for bowling in a coupled according to a first embodiment of the present invention, FIG. 2 is an exploded perspective view illustrating the wrist guard of FIG. 1, FIG. 3 is a view illustrating swing adjustment in she wrist guard of FIG. 1, FIG. 4 is a view illustrating tilt adjustment in the wrist guard of FIG. 1, FIGS. 5 and 6 are top views illustrating states of locking and unlocking a fastening band in the wrist guard of FIG. 1, and FIG. 7 is a view illustrating a state of putting the wrist guard of FIG. 1 on a hand.

A wrist guard 100 according to a first embodiment of the present invention as shown in FIGS. 1 to 7 includes a wrist plate 2, closely attached to a wrist of a user, where a stably-mounting part 1 is formed on one side thereof, a swing bracket 3, pin-connected to the stably-mounting part 1 to be rotatable, a tilt bracket 5, installed on the swing bracket 3 so be slidable, where a coupling groove 4 is formed on one side thereof, a back plate 7 for the back of a hand, pin-connected to the swing bracket 3 so be rotatable, including a protrusion 6 coupled with the coupling groove 4, a swing-adjusting unit variably adjusting a swing angle of the back plate 7 with respect to the wrist plate 2, a tilt-adjusting unit variably adjusting a tilt angle of the back plate 7 with respect to the wrist plate 2, a cover 8 installed on the wrist plate 2 to cover the swing-adjusting unit and the tilt-adjusting unit, operating one of the swing-adjusting unit and the tilt-adjusting unit by sliding, and fastening members 9, as an example, a fastening band, fastening the wrist plate 2 and the back plate 7 to the wrist and the back of a hand to be detachable.

The swing-adjusting unit includes a gear part 10 formed on an outer surface of the swing bracket 3, a first stopper 12, opposite to the gear part 10, mounted on a mounting groove 11 formed on the wrist plate 2, where there is formed a gear tooth 12*a* selectively outer-geared with the gear part 10, and an elastic member 13, as an example, a coiled compressing spring, installed inside the mounting groove 11 to elastically support the first stopper 12.

The tilt-adjusting unit includes a pinion gear 14 fastened inside the tilt bracket 5 to be rotatable, a rack gear part 15 formed on an inner surface of the tilt bracket 5 to be outer-geared with the pinion gear, a second stopper 17, opposite to the pinion gear 14, mounted on a mounting groove 16 formed inside the swing bracket 3, where there is formed a gear tooth 17*a* selectively outer-geared with the pinion gear 14, and an elastic member 18 installed inside the mounting groove 16 to elastically support the second stopper 17.

A first protrusion 19 and a second protrusion 20 are formed on top surfaces of the first stopper 12 and the second stopper 17, respectively, and a first insertion groove 27 and a second insertion groove 21 are formed on a bottom of the cover 8 to correspond to the first protrusion 19 and the second protrusion 20.

The first insertion groove 27 is formed in the shape of a slit to contain the first protrusion 19 transferred in a direction of a straight line and the second insertion groove 21 is formed in the shape of a square to contain the second protrusion 20 while swinging the swing bracket 3.

Fastening holes 22 are formed on sides of the wrist plate 2 and she back plate 7, respectively, so be engaged with one ends of the fastening members 9, locking grooves 26 are formed on the wrist plate 2 and the back plate 7, respectively, to attach or detach lockers 23 fastened to another ends of the fastening members 9.

The locking grooves 26 include locking parts 21, where thresholds 23*a* of the lockers 23 are put into, and engaging parts 25, respectively, the engaging parts 25, connected to the locking parts 24, preventing separations of the lockers 23 transferred from the locking parts 24.

There will be described operations of the wrist guard 100 according to a first embodiment of the present invention as follows.

FIG. 3 illustrates swing adjustment of the wrist guard 100, in which the wrist guard 100 may be put on a wrist and the back of a hand by using the fastening members 9 whose one ends are engaged with the fastening holes 22 formed on the wrist plate 2 and the back plate 7, respectively.

As shown in FIGS. 5 and 6, the lockers 23 fastened to the another ends of the fastening members 9*a* are inserted into the locking grooves 26 formed on the wrist plate 2 and the back plate 7 and fastened thereto. In other words, while putting the thresholds 23*a* of the lockers 23 into the locking parts 24 forming the locking grooves 26, the lockers 23 are horizontally transferred toward the engaging parts 25 extended from the locking parts 24. In this case, the thresholds 23*a* of the lockers 23 are supported by the wrist plate 2 and the back plate 7, thereby preventing separations of the fastening members 9 from the locking grooves 26.

As shown in FIG. 3, while putting on the wrist guard 100, when a user would like to swing-adjust the back plate 7 closely attached to the back of a hand with respect to the wrist plate 2 within a certain angular range, the cover 8 is transferred backwardly (in a direction of an arrow shown in FIG. 1) by a certain distance (transferable within the first insertion groove 27) in such a way that the first protrusion of the first stopper 12 is transferred by the first insertion groove 27 formed on a bottom surface of the cover 8.

In this case, as an imaginary line shown in FIG. 3, the gear tooth 12*a* of the first stopper 12 is separated from the gear part 10 formed on the outer surface of the swing bracket and the elastic member 13 is compressed. Accordingly, since the swing bracket 3 is rotatable on a pin 28 right and left within a certain angular range, the user swing-adjusts the back plate 7 as another imaginary line illustrated in FIG. 3).

Also, after swing-adjusting the back plate 7 with a certain angle, the cover 3 is transferred to an initial position (an original position) in such a way that the first stopper 12 is compressed toward the swing bracket 3 by an elastic restoring force of the elastic member 13. In this case, since the gear tooth 12*a* of the first stopper 12 is outer-geared with the gear part 10 of the swing bracket 3, the back plate 7 may be maintained in a swing-adjusted state. Accordingly, during a bowling game, since it is prevented that the swing bracket 3 is arbitrarily rotated, the user may play the bowling game in a definite and stable state.

FIG. 4 illustrates tilt adjustment of the wrist guard according to the first embodiment. While putting on the wrist guard 100, when the user would like to tilt-adjust the back plate 7 closely attached to the back of a hand with respect to the wrist plate 2 within a certain angular range, the cover 8 is transferred backwardly (in the direction of the arrow shown in FIG. 1) by a certain distance (transferable within the second insertion groove 21) in such a way that the second protrusion 20 of the second stopper 17 is transferred by the second insertion groove 21 formed on the bottom surface of the cover 8.

In this case, as an imaginary line shown in FIG. 4, the gear tooth 17*a* of the second stopper 17 is separated from the pinion gear 14 in which an elastic member 18 is compressed. As an outer-gearing state of the pinion gear 14 and the rack gear part 15 is released in such a way that the tilt bracket 5 may be slid on the swing bracket 3.

Since the protrusion 6 of the back plate 7 is inserted into the coupling groove 4 formed on the tilt bracket 5 and connected thereto, the back plate 7 may be rotated on a pin 30 to be tilted by a sliding of the tilt bracket 5.

When the back plate 7 is tilt-adjusted with the respect to the wrist plate 2 with a certain angle (as another imaginary line shown in FIG. 4), the cover 8 is transferred to the initial position (the original position) in such a way that the second stopper 17 is compressed toward the pinion gear 14 by an elastic restoring force of the elastic member 18. In this case, since the gear tooth 17*a* of the second stopper 17 is outer-geared with the pinion gear 14, the back plate 7 may be maintained in a tilt-adjusted state.

As described above, a wrist guard for bowling according to the present embodiment provides high convenience and reliability since a user, even a beginner, is able to simply swing-adjust or tilt-adjust while putting the wrist guard.

Also, an exterior thereof is simple to increase competitiveness thereof since an angle adjusting unit swing-adjusting or tilt-adjusting is covered by a cover and holing a cloth of the user is prevented not to worry about an injury of the user.

Also, since the wrist guard includes fastening members (fastening bands) used to increase wearability and continuously keep a wearing state in such a way that the user stably plays the bowling game.

Also, since the wrist guard allows the use to hear degrees of rotation via a clicking sound while swing-adjusting or tilt-adjusting, the wrist guard is very convenient to use.

The invention claimed is:

1. A wrist guard for bowling comprising:

a wrist plate, closely attached to a wrist of a user, where a stably-mounting part is formed on one side thereof;

a swing bracket, pin-connected to the stably-mounting part to be rotatable;

a tilt bracket, installed on the swing bracket to be slidable, where a coupling groove is formed on one side thereof;

a back plate for the back of a hand, pin-connected to the swing bracket to be rotatable, comprising a protrusion coupled with the coupling groove;

a swing-adjusting unit variably adjusting a swing angle of the back plate with respect to the wrist plate;

a tilt-adjusting unit variably adjusting a angle of the back plate with respect to the wrist plate;

a cover installed on the wrist plate to cover the swing-adjusting unit and the tilt-adjusting unit, operating one of the swing-adjusting unit and the tilt-adjusting unit by sliding; and fastening members fastening the wrist plate and the back plate to the wrist and the back of a hand to be detachable.

2. The wrist guard of claim 1, wherein the swing-adjusting unit comprises:

a gear part formed on an outer surface of the swing bracket;

a first stopper, opposite to the gear part, mounted on a mounting groove formed on the wrist plate and selectively outer-geared with the gear part; and an elastic member installed inside the mounting groove to elastically support the first stopper.

3. The wrist guard of claim 1, wherein the tilt-adjusting unit comprises:

a pinion gear fastened inside the tilt bracket to be rotatable;

a rack gear part formed on an inner surface of the tilt bracket to be outer-geared with the pinion gear;

a second stopper, opposite to the pinion gear, mounted on a mounting groove formed inside the swing bracket and selectively outer-geared with the pinion gear; and an elastic member installed inside the mounting groove to elastically support the second stopper.

4. The wrist guard of claim 2, wherein a first protrusion and a second protrusion are formed on top surfaces of the first stopper and the second stopper, respectively, and a first insertion groove and a second insertion groove are formed on a bottom of the cover to correspond to the first protrusion and the second protrusion.

5. The wrist guard of claim 4, wherein the first insertion groove is formed in the shape of a slit to contain the first protrusion transferred in a direction of a straight line and the second insertion groove is formed in the shape of a square to contain the second protrusion while swinging the swing bracket.

6. The wrist guard of claim 1, wherein fastening holes are formed on sides of the wrist plate and the back plate, respectively, to be engaged with one ends of the fastening members, wherein locking grooves are formed on the wrist plate and the back plate, respectively, to attach or detach a locker fastened to another ends of the fastening members, and wherein the locking grooves comprise locking parts and engaging parts, respectively, the engaging parts, connected to the locking parts, preventing a separation of the locker transferred from the locking part.

* * * * *